US010294431B2

(12) United States Patent
Kohler et al.

(10) Patent No.: US 10,294,431 B2
(45) Date of Patent: May 21, 2019

(54) HEAVY SYNTHETIC FUEL

(71) Applicant: Sasol Technology (Pty) Ltd, Johannesburg (ZA)

(72) Inventors: Luis Pablo Fidel Dancaurt Kohler, Sasolburg (ZA); Paulus Stephanus Gravett, Vanderbijlpark (ZA); Jacques Van Heerden, Vanderbijlpark (ZA)

(73) Assignee: Sasol Technology (Pty) Ltd, Johannesburg (ZA)

( * ) Notice: Subject to any disclaimer, the term of this patent is extended or adjusted under 35 U.S.C. 154(b) by 297 days.

(21) Appl. No.: 14/383,073

(22) PCT Filed: Mar. 5, 2013

(86) PCT No.: PCT/ZA2013/000009

§ 371 (c)(1),
(2) Date: Sep. 4, 2014

(87) PCT Pub. No.: WO2013/134793

PCT Pub. Date: Sep. 12, 2013

(65) Prior Publication Data

US 2015/0072298 A1 Mar. 12, 2015

(30) Foreign Application Priority Data

Mar. 5, 2012 (ZA) ..... 2012/01623

(51) Int. Cl.
*C10G 2/00* (2006.01)
*C10L 1/04* (2006.01)
(Continued)

(52) U.S. Cl.
CPC ..... *C10G 67/02* (2013.01); *C10G 2/00* (2013.01); *C10G 45/58* (2013.01); *C10G 47/00* (2013.01);
(Continued)

(58) Field of Classification Search
CPC ..... C10G 2300/1022; C10G 2300/202; C10G 2300/302; C10G 2300/304;
(Continued)

(56) References Cited

U.S. PATENT DOCUMENTS 3,303,128 A * 2/1967 Peel ..... C10L 1/04 208/15
8,466,329 B2 * 6/2013 Roets ..... C10G 2/30 208/15
(Continued)

FOREIGN PATENT DOCUMENTS

EP 1845151 A1 10/2007
WO WO-0014183 A1 * 3/2000 ..... B01J 35/023
WO WO-0014187 A2 * 3/2000 ..... C10G 65/043

OTHER PUBLICATIONS

Gravett et al., "The use of environmental acceptable synthetic fuel oils and blends thereof with crude derived heavy fuel oil", 9th International Conference on Stability, Handling and Use of Liquid Fuels, Edited by Robert E. Morris and Steven R. Westbrook, vol. 1, Sep. 22, 2005, pp. 325-364.
(Continued)

*Primary Examiner* — Latosha Hines
(74) *Attorney, Agent, or Firm* — Knobbe Martens Olson & Bear, LLP

(57) ABSTRACT

The invention provides a process for the production of a fully synthetic heavy fuel oil, said process including at least fractionation of hydrocarbons obtained from the hydroconversion of C5 and heavier Fischer-Tropsch (FT) process products to obtain a product that is heavier than a middle distillate and has an ASTM D86 cut-off temperature in excess of 350° C. Further, the invention provides a fuel made in accordance with the process.

17 Claims, 1 Drawing Sheet

(51) Int. Cl.

| | |
|---|---|
| ***C10L 1/08*** | (2006.01) |
| ***C10G 67/02*** | (2006.01) |
| ***C10G 45/58*** | (2006.01) |
| ***C10G 47/00*** | (2006.01) |

(52) U.S. Cl.
CPC ..... *C10L 1/04* (2013.01); *C10L 1/08* (2013.01); *C10G 2300/1022* (2013.01); *C10G 2300/202* (2013.01); *C10G 2300/302* (2013.01); *C10G 2300/304* (2013.01); *C10G 2300/308* (2013.01); *C10L 2200/0407* (2013.01); *C10L 2200/0438* (2013.01); *C10L 2200/0476* (2013.01); *C10L 2200/0492* (2013.01); *C10L 2270/026* (2013.01); *C10L 2290/10* (2013.01); *C10L 2290/42* (2013.01); *C10L 2290/543* (2013.01); *C10L 2300/20* (2013.01)

(58) Field of Classification Search
CPC ..... C10G 2300/308; C10G 2300/20; C10G 2/00; C10G 45/58; C10G 47/00; C10G 67/02; C10L 1/04; C10L 1/08; C10L 2200/0407; C10L 2200/0438; C10L 2200/0476; C10L 2200/0492; C10L 2270/026; C10L 2290/10; C10L 2290/42; C10L 2290/543; C10L 2290/0438; C10L 2300/20
USPC ..... 208/110; 432/29; 585/16
See application file for complete search history.

(56) References Cited

U.S. PATENT DOCUMENTS

| | | | | |
|---|---|---|---|---|
| 2006/0016722 | A1* | 1/2006 | Espinoza | C10G 2/32 208/14 |
| 2009/0158641 | A1* | 6/2009 | Hayes | C10L 1/04 44/309 |
| 2009/0209793 | A1* | 8/2009 | Selby | C10L 10/02 585/1 |

OTHER PUBLICATIONS

International Preliminary Report on Patentability for PCT International Appl. No. PCT/ZA2013/000009 dated May 22, 2014.
Written Opinion of the International Searching Authority for PCT International Appl. No. PCT/ZA2013/000009 dated Jul. 18, 2013.

* cited by examiner

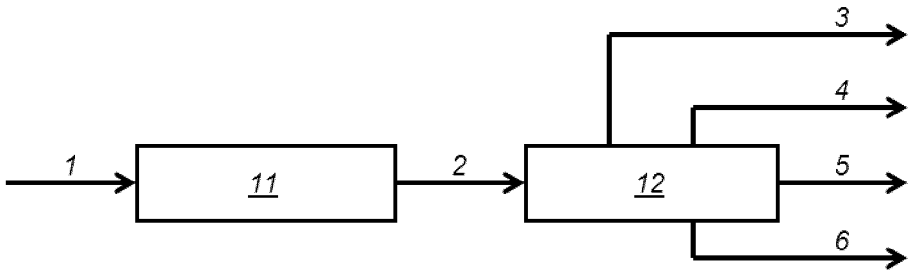
1
11
2
12
3
4
5
6

HEAVY SYNTHETIC FUEL

FIELD OF THE INVENTION

The present invention relates to a synthetic heavy fuel oil composition suitable for use in heat or power generation applications and the like, including its use in marine systems and direct heat processing.

BACKGROUND OF THE INVENTION

Residual fuel oils, also known as heavy or bunker fuel oils, are typically used as transportation fuel in marine applications and as burner fuel for power or heat generation purposes in industrial applications. Historically these fuel oils consist of the residue from distillation processes in crude oil refineries, including vacuum and cracking units. As such, they comprise complex mixtures of high molecular weight, high density compounds, with higher viscosity. They have a typical boiling range from about 350° C. to about 650° C.; and carbon numbers in the range from about $C_{20}$ to $C_{50}$ or above.

Critically, these residual fuel oils will almost inevitably contain high levels of organo-metallic, complex aromatic and hetero-species which remain behind as a residue of the distillation process. As such, on combustion, heavy fuel oils are significant sources of pollutants such as metals, soot and sulphur oxide species; and in their use, including marine applications, can represent a substantial environmental hazard in the case of spillage. Furthermore, in some sensitive direct heating applications (such as those in the food or pharmaceutical industries), the presence of sulphur, aromatics and metals in the fuel oil is highly undesirable because of the potential impact on product generation and purity.

These problems are all exacerbated in the current situation where the global supply of crude oils is shifting to lower qualities with concomitantly higher contents of sulphur, metals and other contaminants ending up in the residual fractions—resulting in crude-derived heavy fuel oils which are hence of considerable concern from both a health and environmental perspective.

In the marine environment, for example, current regulations have been introduced requiring the use of low-sulphur fuels in designated near-shore Emission Control Areas (ECA's). Whilst abatement technologies are a viable (if expensive) alternative; these regulations have typically required the use of middle distillate fuels in order to meet the requirement as these can be easily obtained with low sulphur content. Switching between distillate in ECA's and the more cost-effective residual fuel outside of these areas can cause significant technical problems on board ship. These are almost all the result of mismatch between the properties of middle distillate and heavy fuel oil such as viscosity and density, in complex systems which have been designed around the inherent properties of heavy fuel oil as discussed in "Special Report: Global marine fuel-switching to comply with sulphur emissions limits—problems and solutions"; John Liddy; Feb. 7, 2011; International Fuel Quality Center.

Crude-derived heavy fuel oils, whilst fulfilling a significant energy source requirement; are hence becoming more and more problematic in terms of the inherent pollutants and environmental impact associated with their use. Whilst it may be possible to substitute this fuel oil with cleaner middle distillate in certain applications, the property differences between these products renders this solution sub-optimal for many purposes. There is therefore a strong need for a suitable high quality, high performance, non-polluting replacement fuel that can be used in these types of applications.

SUMMARY OF THE INVENTION

According to a first aspect of the invention, there is provided a fully synthetic heavy fuel oil, said fuel oil having:

a sulphur content of less than 100 ppm;

an aromatics content of less than 2 mass %;

a density of more than 0.800 $g \cdot cm^{-3}$ (at 20° C.);

a kinematic viscosity greater than 8 $mm^2/s$ (at 50° C.); and a pour point of 30° C. or less.

The pour point is measured in accordance with ASTM D5985-02(2008) Standard Test Method for Pour Point of Petroleum Products.

The fuel oil may have a gross heating value of at least 45.5 MJ/kg. It may more preferably have a gross heating value of at least 46.0 MJ/kg.

The fuel oil may have a kinematic viscosity of less than 20 $mm^2/s$ measured at 50° C.

The fuel oil may have a sulphur content less than 50 ppm.

The fuel oil may have an aromatics content less than 1 mass %.

The fuel oil may have a linear paraffinic content of at least 90 weight %.

The fuel oil may have a density more than 0.810 $g \cdot cm^{-3}$ (at 20° C.).

The fuel oil may have a pour point of less than 25° C.

The fuel oil may be used either as a fuel on its own or as a fuel blendstock.

According to a second aspect of the invention, there is provided a process for the production of a fully synthetic heavy fuel oil, said process including at least fractionation of hydrocarbons obtained from the hydroconversion of $C_5$ and heavier Fischer-Tropsch (FT) process products to obtain a product that is heavier than a middle distillate and has an ASTM D86 cut-off temperature in excess of 350° C.

The ASTM D86 cut-off temperature may be in excess of 376° C.

For better understanding, and without limiting the scope of the invention, a heavier fraction of hydrocarbons is obtained from the fractionation of a product of hydroconversion of $C_5$ and heavier Fischer-Tropsch (FT) process products, which is sometimes referred to as the bottoms of the hydrocracker or hydroisomerisation unit, and is typically heavier than middle distillate. A lighter fraction(s) obtained may be used for other product streams. The heavy synthetic fuel oil has a distillation temperature cut-off in excess of 350° C.; and would hence, in the case of paraffins, be heavier than about $C_{19}$.

The product may be a hydroisomerised (HI) wax.

The product may include borderline middle distillate.

The fully synthetic heavy fuel oil may be blended with one or more FT-derived hydrocarbons.

The FT-derived hydrocarbon may be a middle distillate product.

The FT-derived hydrocarbon may include borderline middle distillate.

The fully synthetic heavy fuel oil may be blended with hydrocarbons selected from the group including gas oil fractions as obtained in crude refinery processes and non-crude oil based fuels, such as bio-fuels or combinations thereof The fully synthetic heavy fuel oil may be blended with crude-derived heavy fuel oil that contains sulphur and aromatic levels that are elevated beyond desired specification limits.

The blending ratio's by volume of fully synthetic heavy fuel oil to crude-derived heavy fuel oil may be from 99.1 to 1:99, typically from 80:20 to 20:80, in some embodiments from 67:33 to 33:67, and in other embodiments from 55:45 to 45:55.

According to a third aspect of the invention, there is provided a process for producing a synthetic heavy fuel oil, said process comprising:

subjecting a $C_5$ and heavier product obtained from a Fischer Tropsch process to a hydroconversion process to generate a hydroconverted stream; and fractionating the hydroconverted stream to produce at least a heavy fraction having an ASTM D86 cut-off temperature in excess of 350° C.

The heavy fraction may have:

a. less than 100 ppm sulphur;

b. less than 2 mass % aromatics;

c. a density more than 0.800 $g \cdot cm^{-3}$ (at 20° C.);

d. a kinematic viscosity greater than 8 $mm^2/s$ (at 50° C.); and e. a pour point of 30° C. or less.

The hydroconversion process may be a hydrocracking or hydroisomerisation process.

The heavy fraction obtained may have an ASTM D86 cut-off temperature of in excess of 376° C.

DEFINITIONS

For the purpose of this disclosure and unless otherwise defined "heavier or heavy" and "lighter or light" are intended to relate to the boiling point range of the fraction. The terms are also intended to mean heavier and lighter relative to each other. In absolute terms, a heavy fraction may also be used to describe a fraction in which at least 80% by weight of components have an ASTM D86 boiling point greater than 350° C.

"Middle distillates" as used herein means fuel fractions that have distillation temperatures between about 150° C. and 370° C., i.e. like kerosene and diesel, or have carbon numbers between about $C_{10}$ and $C_{23}$.

In this context, the term "borderline middle distillate" is defined as a distillate material that includes components from the lighter side of the distillation curve of a heavy fuel oil fraction that may or may not be obtained after vacuum distillation. Through judicious choice of the lower distillation temperature cut-off, this material may be deliberately included or excluded in the heavy fuel oil fraction.

"Hydroisomerised (HI) wax" as used herein means a heavier fraction obtained from the fractionation of a product from the hydroconversion of the $C_5$ and heavier materials of the FT process.

"Hydroconversion" or "hydroprocessing" as used herein means either a hydrocracking process and/or hydroisomerisation process. These processes are well known to a person skilled in the art and described in common reference books like "Petroleum Refining—Technology and Economics" by J H Gary and G E Handwerk (1984).

"GTL" or "Gas-to-Liquids" is a well known industrial process used to convert natural gas or other gaseous hydrocarbons into longer-chain hydrocarbons such as naphtha, and middle distillates like diesel fuel. Methane-rich gases are converted into liquid synthetic fuels either via direct conversion or via syngas as an intermediate, for example using the Fischer Tropsch or Mobil processes. Optionally, the GTL process might include additional conversion steps.

"GTL fuel", "GTL wax", or similar terms mean a fuel, wax, or other hydrocarbon produced by the GTL process.

"Residual middle distillate" is defined as a middle distillate range material that is deliberately allowed to remain in the heavy fuel oil fraction after distillation or fractionation.

DETAILED DESCRIPTION OF THE INVENTION

Work carried out by the inventors on specific fractions of GTL hydroisomerised (HI) wax has identified that this stream can, very surprisingly, be easily substituted for traditional crude-derived heavy fuel oil from a practical perspective.

It additionally has several significant advantages over crude-derived heavy fuel oil, namely:

a highly relevant kinematic viscosity range for use as a heavy fuel oil analogue. Initial kinematic viscosity values for the GTL HI wax are surprisingly less than 18 $mm^2/s$ (measured at 50° C.). It has been found that the fuel oil viscosity (measured at 50° C.) can be controlled between about 20 $mm^2/s$ and about 8 $mm^2/s$ by manipulating the low levels of middle distillate material that are retained. This is achieved through appropriate selection of the lower distillation cut-off temperature (also known as Initial Boiling Point (IBP).

a pour point that is equal to, or less than, 30° C.; and can be as low as 12° C. depending on the amount of residual middle distillate material that is retained in the GTL HI wax.

a very low sulphur and aromatic content, consistent with all Fischer-Tropsch (FT)-derived fuels.

substantially increased energy content, or gross heating value, over that which can be obtained from crude-derived heavy fuel oil which traditionally has values close to 43 MJ/kg.

excellent emission and biodegradability properties.

The Fischer Tropsch Process

The FT synthesis can be practised commercially at two temperature ranges: (i) the so-called Low Temperature Fischer-Tropsch (LTFT), typically below 300° C., and (ii) the so-called High Temperature Fischer-Tropsch (HTFT), typically above 300° C.

In the case of this invention; the LTFT process is preferred because of the inherent nature of the product that is generated.

The FT process is used industrially to convert synthesis gas, derived from coal, natural gas, biomass or heavy oil streams, into hydrocarbons ranging from methane to species with molecular masses above 1400. While the main products are linear paraffinic materials, other species such as branched paraffins, olefins and oxygenated components form part of the product slate. The exact product slate depends on reactor configuration, operating conditions and the catalyst that is employed, as is evident from e. g. *Catal. Rev.-Sci. Eng.*, 23 (1 & 2), 265-278 (1981).

Preferred reactors for the production of heavier hydrocarbons are slurry bed or tubular fixed bed reactors, while operating conditions are preferably in the range of 160-280° C., in some cases 210-260° C.; and 18-50 bar, in some cases 20-30 bar. A preferred active metal in the catalyst may comprise iron, ruthenium or cobalt. While each catalyst will give its own unique product slate; in all cases, the product slate contains some waxy, highly paraffinic material which needs to be further upgraded into usable products.

The FT products can be converted into a range of final products, such as middle distillates, naphtha, solvents, lube oil bases, etc. Such conversion, which usually consists of a range of processes such as hydrocracking, hydrotreatment and distillation, can be termed the FT work-up process.

The FT work-up process of this invention uses a feed stream consisting of $C_5$ and higher hydrocarbons derived from the FT process. This feed can be separated into at least two individual fractions, a heavier and at least one lighter fraction. The heavier fraction, also referred to as wax, contains a considerable amount of hydrocarbon material, which boils considerably higher than the normal diesel boiling point range (160-370° C.). Typically, all hydrocarbon species boiling above about 370° C. would be converted into lighter materials by means of a catalytic process. This is often referred to as hydroprocessing, for example, hydrocracking.

Catalysts for this step are of the bi-functional type; i.e. they contain sites active for cracking and for hydrogenation. Catalytic metals active for hydrogenation include group VIII noble metals, such as platinum or palladium, or a sulphided Group VIII base metals, e. g. nickel, cobalt, which may or may not include a sulphided Group VI metal, e. g. molybdenum. The support for the metals can be any refractory oxide, such as silica, alumina, titania, zirconia, vanadia and other Group III, IV, VA and VI oxides, alone or in combination with other refractory oxides. Alternatively, the support can partly or totally consist of a zeolite or any other suitable molecular sieve.

Process parameters for hydroprocessing can be varied over a wide range and are usually laboriously chosen after extensive experimentation to optimize the yield of middle distillates.

Hydroprocessing

FT products including wax, condensate and other liquid hydrocarbon species are converted to final products during hydroprocessing or hydrocracking. These are combined with hydrogen and fed into the hydroprocessing reactor where the hydrocarbons are cracked and isomerised to the targeted extent, based on the selected processing conditions. This unit operates at petroleum refinery typical conditions.

The catalyst preferred for use in such a hydroprocessing step is bifunctional (defined as containing both acid and metal sites. The former promote cracking reactions and the latter hydrogenation/dehydrogenation reactions. For this invention, suitable catalysts would be:

- Group 6 (VI) and group 8 (VIII) transition metals on amorphous silica-alumina (ASA) or Y-zeolite, or
- Group 8 (VIII) noble metals on amorphous silica-alumina (ASA) or Y-zeolite, or
- Group 8 (VIII) noble metals on a molecular sieve support (SAPO)

Specific exemplary conditions for operating such a hydroprocessing unit would therefore include utilising a catalyst comprising a Group VI and a Group VIII metal on an aluminosilicate support under temperature conditions of 380-420° C. and pressure conditions of approximately 30-75 bar, preferably 50-75 bar.

The reactor products of such a hydroprocessing step are cooled, separated and unconverted hydrogen recycled to the reactor, while the liquids are fed to fractionation columns to produce diesel, kerosene, naphtha and LPG. The unconverted heavy material/fraction is returned to the reactor.

The process usable for the production of these LTFT-derived fuel oils is shown for illustration purposes in FIG. 1. In FIG. 1, syngas (1) enters the Fischer-Tropsch synthesis unit 11 where it is converted using a suitable catalyst into a broad range of primarily paraffinic hydrocarbons. The liquid Fischer-Tropsch products (2) are hydroconverted in a hydroconversion unit 12 undergoing both hydrocracking and hydroisomerisation reactions. The products from this conversion step are separated by distillation according to their boiling points thus obtaining light gas species (3), naphtha (4), one or more middle distillate streams (5) and industrial fuel (6). Optionally, stream (6) might be returned to unit 12 for further processing.

This process has been described in the past in, for example, EP 1 171 551 B1. The specific distinction of the method of this invention over the prior art is that where the unconverted heavy material/fraction would typically have been recycled to extinction to the hydroconversion unit, this stream is instead retained. The synthesis gas can be produced using natural gas by a reforming process or alternatively by gasification of coal or any suitable hydrocarbonaceous feedstock.

GTL Hydroisomerised Wax

Hydroisomerised (HI) wax is the unconverted heavy material/fraction (or bottoms fraction) that would typically be recycled to the hydroprocessing reactors to provide additional light fraction(s) or is further processed to produce base oils. This stream is isolated by fractionation to obtain a product that is typically heavier than the middle distillate fraction. The ASTM D86 distillation cut-off temperature for this separation is typically greater than approximately 376° C., and can be adjusted upwards to obtain desired properties in the HI wax extracted.

This finding therefore represents an additional flow scheme option which would be of particular use in FT refining scenarios where the hydroconversion unit is capacity-constrained and/or where there is no market demand for a base oil product.

The hydroisomerized wax of the present invention may be used neat in the application or it may additionally comprise a blend with other fuel streams. These may be FT-derived streams such as middle distillate product; or may be other than those derived from the FT process. Examples of such components may be gas oil fractions as obtained in traditional refinery processes, which upgrade crude petroleum feedstock to useful products. Optionally non-crude oil based fuels, such as bio-fuels, may also be present in the fuel composition.

The synthetic heavy fuel oil of this invention may also find particular application in blends with crude-derived heavy fuel oil that contains sulphur and aromatic levels that are elevated beyond desired specification limits. It can be used to modify/dilute these levels in crude-derived heavy fuel oils without detrimentally affecting other properties relevant to use in the application as might be the use with low sulphur distillate blend options.

Gross Heating Value

The FT-derived fuel oil or HI wax of this invention has the advantage of higher gravimetric energy value compared to the gravimetric energy value of crude oil derived fuel oils. The term "gross heating value", also known as gross calorific value or higher heating value is used to refer to the amount of heat released by a specified quantity of the fuel once it is combusted and the products have returned to a temperature of 25° C. (hence taking into account the latent heat of vapourisation of the water in the combustion products). This value is obviously related to the energy content of the fuel and hence has significant implications in terms of the commercial value of the product as a function of fuel consumption and efficiency.

The gross heating value can be determined analytically according to the ASTM method D240-09 (Standard Test Method for Heat of Combustion of Liquid Hydrocarbon Fuels by Bomb calorimeter). It may also be estimated according to the thermochemical properties of the components.

Physical Properties: Fuel Kinematic Viscosity, Density and Pour Point

The FT-derived fuel oil of this invention has the advantage of a relevant kinematic viscosity range, namely 8 to 20 $mm^2/s$ (as measured at 50° C.). Many of the applications of heavy fuel oil are designed around the inherent physical properties of the fuel. In technologies requiring fuel injection, or even pumping; the anticipated higher viscosities and densities of heavy fuel oil during system design make substitution with low sulphur/aromatic middle distillate product problematic. In many cases, the systems may even be incompatible with distillate use. The HI wax product of this invention hence has kinematic viscosity and density values that are far more compatible with typical fuel oil applications than does middle distillate product.

The pour point of a fuel is critical for managing storage and handling aspects. Typically more paraffinic oils would be expected to have poor pour point behaviour because of the ease of crystallisation of certain waxy components. Most surprisingly, the synthetic heavy fuel oil of this invention has a pour point of 30° C. or less; and this can be reduced much further to approximately 12° C. (through a relatively small manipulation of the IBP value).

Low Metal, Aromatic and Sulphur Contents

A distinct characteristic of FT-derived products is that they contain negligible levels of sulphur and metals comprising vanadium, aluminium, mercury, lead and nickel, which makes them an attractive environmentally acceptable energy source. FT-derived products also contain very low levels of aromatics. Hence FT-derived product, such as HI wax, is extremely suitable for use in environmentally sensitive applications, or where crude-derived contaminants would be of concern.

The desirable chemistry of this synthetic heavy fuel oil also creates an opportunity for blending with high sulphur fuels oil obtained from crude oil refineries—allowing for dilution of sulphur and aromatic content in environmentally sensitive areas.

Effect of Residual Middle Distillate Fraction

The physical properties, particularly the kinematic viscosity and density of the HI wax can be modified by selecting the lower distillation cut-off temperature to facilitate inclusion of borderline middle distillate material. This allows tailoring the HI wax product for specific applications as required. It has been found that the viscosity can be modified between 8 and 18 $mm^2/s$ (as measured at 50° C.) and the density between approximately 0.805 and 0.820 $g \cdot cm^{-3}$ (as measured at 20° C.). Modification of viscosity and density parameters is achieved by manipulating the Initial Boiling Point (IBP) upwards by about 30° C. from approximately 370° C.

Applications for the Synthetic Heavy Fuel Oil

GTL HI wax is suitable for use in multiple heavy fuel oil applications. It will be particularly useful in applications where there is sensitivity to sulphur, aromatic and heavy metal contaminants such as for heating in the food or pharmaceutical industries; or as a marine bunker fuel in ECA's.

GTL HI wax can also be used in the high temperature glass melting industry where good radiation properties are of utmost importance; or in low temperature applications where convection properties are required The very low metal content reflected in the low ash content also makes this fuel oil a very attractive fuel in high temperature applications. Whilst the product of this invention can be used neat in many applications as a suitable fuel oil; it can equally be used as a blendstock to reduce the effective sulphur or aromatic content of another crude-derived stream.

The invention will now be described with reference to the following nonlimiting examples.

Example 1

A hydroisomerised (HI) FT wax product, identified as FUEL A, was separated after hydroprocessing during FT product work-up—distilled as the +376° C. fraction (i.e. heavier than diesel). Table 1 below shows the physical properties of this fuel stream. This sample is characterised by the presence of some borderline middle distillate material which has a significant effect on its physical properties—notably viscosity and density.

FUEL A was then further fractionated (+400° C.) to extract the maximum amount of middle distillate from the stream. The resultant waxy residue, identified as FUEL F, was then analysed in a similar manner to the above. The results are also shown in Table 1.

TABLE 1

| Component | Units | FUEL A | FUEL F |
|---|---|---|---|
| Distillation IBP | ° C. | 376 | 400 |
| Ash | mass % | <0.01 | <0.01 |
| Density @ 20° C. | kg/l | 0.8064 | 0.8177 |
| Gross Heating value | MJ/kg | 46.19 | 46.01 |
| Flash Point | ° C. | 60 | 196 |
| Pour Point | ° C. | 12 | 30 |
| Total Sulphur | mass % | <0.01 | <0.01 |
| Kinematic viscosity @ 50° C. | $mm^2/s$ | 9.7 | 18.45 |
| Kinematic viscosity @ 100° C. | $mm^2/s$ | | 5.6 |
| Water Content | vol % | <0.05 | <0.05 |

The differences between samples FUEL A and FUEL F indicate the strong effect that the presence of residual middle distillate fraction can have on the physical properties of the HI wax. The relatively high gross heating values of both samples is also noteworthy.

Table 2 further characterises the effect of various amounts of added middle distillate (eg GTL diesel) on the properties of FUEL F up to a maximum of approximately 20 volume added diesel material. The physical properties of the blended HI wax sample at the maximum added middle distillate content of 20 volume % are largely comparable with those observed for FUEL A above.

TABLE 2

| Component | Units | GTL HI wax | GTL HI wax 10 | GTL HI wax 20 |
|---|---|---|---|---|
| Added GTL diesel | vol % | 0 | 10 | 20 |
| Ash | mass % | <0.01 | <0.01 | <0.01 |
| Density @ 20° C. | kg/l | 0.8172 | 0.8147 | 0.8104 |
| Gross Heating value | MJ/kg | 46.02 | 46.06 | 46.13 |
| Flash Point | ° C. | 196 | 112 | 67 |
| Pour Point | ° C. | 30 | 30 | 15 |
| Total Sulphur | mass % | <0.01 | <0.01 | <0.01 |
| Kinematic viscosity @ 50° C. | $mm^2/s$ | 15 | 12 | 10 |

TABLE 2-continued

| Component | Units | GTL HI wax | GTL HI wax 10 | GTL HI wax 20 |
|---|---|---|---|---|
| Distillation curve details as per ASTM D2887 | | | | |
| Initial boiling point | ° C. | 256 | 236 | 229 |
| 10% | ° C. | 385 | 381 | 387 |
| 50% | ° C. | 421 | 418 | 413 |
| 90% | ° C. | 532 | 517 | 513 |
| Final boiling point | ° C. | 572 | 589 | 581 |

A series of experiments was then carried out to assess the environmental fate of the GTL HI wax samples prepared from FUEL F with added GTL diesel fractions. The biodegradation behaviour of the samples was assessed using the OECD 301F methodology for determining ready biodegradability. In all cases, the HI wax samples (with 0, 10 and 20 volume %) significantly exceeded 10% biodegradability at 28 days—and hence these HI wax samples are classified as "inherently biodegradable".

Example 2

Experiments were then carried out looking at the effect of blending HI wax with various other fuel oil grade streams or products. These experiments included blends with both FUEL A and FUEL F samples to indicate the effect of the additional distillate material of the latter on the properties.

TABLE 3

Properties obtained when blending various types of HI wax with biodiesel

| Component | Units | FUEL H 50:50 FUEL F: Biodiesel | FUEL I 50:50 FUEL A: Biodiesel | FUEL J Biodiesel |
|---|---|---|---|---|
| Ash | mass % | <0.01 | <0.01 | <0.01 |
| Density @ 20° C. | kg/l | 0.8506 | 0.8447 | 0.8836 |
| Gross heating value | MJ/kg | 43.478 | 43.910 | 43.116 |
| Flash Point | ° C. | 142 | 114 | 144 |
| Pour Point | ° C. | 18 | 6 | −12 |
| Total Sulphur | mass % | <0.01 | <0.01 | <0.01 |
| Kinematic viscosity @ 50° C. | $mm^2/s$ | 7.4 | 5.8 | 3.9 |
| Water Content | vol % | <0.05 | <0.05 | <0.05 |

TABLE 4

Properties obtained when blending various types of HI wax with crude-derived Light Cycle Oil (LCO)

| Component | Units | LCO | FUEL C 50:50 FUEL A: LCO | FUEL G 50:50 FUEL F: LCO |
|---|---|---|---|---|
| Ash | mass % | <0.01 | <0.01 | <0.01 |
| Density @ 20° C. | kg/l | 0.967 | 0.886 | 0.8933 |
| Gross Heating value | MJ/kg | 43.54 | 44.78 | 44.64 |
| Flash Point | ° C. | 49 | 56 | 94 |
| Pour Point | ° C. | −8 | −6 | 3 |
| Total sulphur | mass % | 1.36 | 0.68 | 0.69 |
| Kinematic viscosity @ 50° C. | $mm^2/s$ | 3.6 | 5.1 | 6.5 |
| Water Content | vol % | <0.05 | <0.05 | <0.05 |

TABLE 5

Properties obtained when blending HI wax with various other crude-derived streams

| Component | Units | FUEL B 98:2 FUEL A: GTL Naphtha | FUEL C 50:50 FUEL A: Kero Merox | FUEL D 50:50 FUEL A: CDU Heavy Diesel | FUEL E 50:50 FUEL A: LCO |
|---|---|---|---|---|---|
| Ash | mass % | <0.01 | <0.01 | <0.01 | <0.01 |
| Density @ 20° C. | kg/l | 0.8043 | 0.8081 | 0.8356 | 0.886 |
| Gross Heating value | MJ/kg | 46.22 | 46.16 | 45.70 | 44.78 |
| Flash point | ° C. | 29 | 55 | 86 | 56 |
| Pour point | ° C. | 9 | −24 | 0 | −6 |
| Total sulphur | mass % | <0.01 | 0.05 | 0.3 | 0.68 |
| Kinematic viscosity @ 50° C. | $mm^2/s$ | 8.9 | 3.1 | 5.8 | 5.1 |
| Water Content | vol % | <0.05 | <0.05 | <0.05 | <0.05 |

As is evident from these blend studies; the HI wax of this invention blends well with various other fuel oils to give satisfactory product. Furthermore, it is also possible to utilise HI wax material that has varying amounts of residual distillate in order to manipulate the properties of the end product satisfactorily.

The invention claimed is:

1. A synthetic heavy fuel oil comprising:

less than 100 ppm sulfur;

at least 90 wt. % of linear paraffins that are heavier than $C_{19}$; and less than 2 mass % aromatics, wherein the synthetic heavy fuel oil has a density of more than 0.800 $g \cdot cm^3$ (at 20° C.), a kinematic viscosity of greater than 8 $mm^2/s$ (at 50° C.) and less than 20 $mm^2/s$ (at 50° C.), and a pour point of at least 12° C. and less than 25° C.

2. The synthetic heavy fuel oil of claim 1, wherein the fuel oil has a gross heating value of at least 45.5 MJ/kg.

3. The synthetic heavy fuel oil of claim 2, wherein the fuel oil has a gross heating value of at least 46.0 MJ/kg.

4. The synthetic heavy fuel oil of claim 1, wherein the sulfur content is less than 50 ppm.

5. The synthetic heavy fuel oil of claim 1, wherein the aromatics content is less than 1 mass %.

6. The synthetic heavy fuel oil of claim 1, wherein the density is more than 0.810 $g \cdot cm^3$ (at 20° C.).

7. A process for producing a synthetic heavy fuel oil, comprising:

subjecting a $C_5$ and heavier product obtained from a Fischer-Tropsch process to a hydroconversion process to generate a hydroconverted stream; and fractionating the hydroconverted stream to obtain a heavy fraction having an ASTM D86 cut-off temperature in excess of 350° C. to obtain the synthetic heavy fuel oil of claim 1, wherein a lower distillation cut-off temperature is selected so as to obtain a preselected viscosity.

8. The process of claim 7, wherein a middle distillate material is retained in the heavy fraction by selection of the lower distillation cut-off temperature.

9. The process of claim 7, wherein the lower distillation cut-off temperature is approximately 30° C. higher than approximately 370° C.

10. The process of claim 7, wherein the heavy fraction has an ASTM D86 cut-off temperature in excess of 376° C.

11. The process of claim 7, wherein the hydroconversion process is a hydrocracking process or hydroisomerization process.

12. The process of claim 7, further comprising blending the heavy fraction with one or more Fischer-Tropsch derived hydrocarbons.

13. The process of claim 12, wherein the Fischer-Tropsch derived hydrocarbons include a middle distillate.

14. A process for direct combustion heating, comprising:

combusting the synthetic fuel oil of claim 1 in a presence of air to generate heat; and using the heat generated as a source of direct heating in a food production process or a pharmaceutical production process.

15. The synthetic heavy fuel oil of claim 1, having carbon numbers in a range from $C_{20}$ to $C_{50}$.

16. The synthetic heavy fuel oil of claim 1, having an ASTM D86 cut-off temperature in excess of 350° C.

17. The synthetic heavy fuel oil of claim 1, having an ASTM D86 cut-off temperature in excess of 376° C.

* * * * *